US011125526B2

(12) United States Patent
Jezwinski

(10) Patent No.: US 11,125,526 B2
(45) Date of Patent: Sep. 21, 2021

(54) BOW RELEASE DEVICE AND METHOD

(71) Applicant: Ryan L. Jezwinski, Oshkosh, WI (US)

(72) Inventor: Ryan L. Jezwinski, Oshkosh, WI (US)

( * ) Notice: Subject to any disclaimer, the term of this patent is extended or adjusted under 35 U.S.C. 154(b) by 0 days.

(21) Appl. No.: 16/901,551

(22) Filed: Jun. 15, 2020

(65) Prior Publication Data

US 2020/0309480 A1 Oct. 1, 2020

Related U.S. Application Data

(63) Continuation-in-part of application No. 16/501,879, filed on Jun. 21, 2019, now Pat. No. 10,697,729.

(60) Provisional application No. 62/763,721, filed on Jun. 28, 2018.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 4,674,469 A * 6/1987 Peck ..... F41B 5/1438 124/32
4,860,720 A * 8/1989 Todd ..... F41B 5/1469 124/35.2
4,949,698 A * 8/1990 Burnham ..... F41B 5/1469 124/35.2
5,307,788 A * 5/1994 Peck ..... F41B 5/1469 124/35.2
5,370,102 A * 12/1994 Peck ..... F41B 5/1469 124/35.2
5,417,197 A * 5/1995 Bankstahl ..... F41B 5/1469 124/35.2
5,564,407 A * 10/1996 Linsmeyer ..... F41B 5/1469 124/35.2
5,582,158 A * 12/1996 Linsmeyer ..... F41B 5/1469 124/35.2
6,481,430 B1 * 11/2002 Lightcap, Jr. ..... F41B 5/1469 124/35.2
6,484,710 B1 * 11/2002 Summers ..... F41B 5/1469 124/35.2
6,925,995 B1 * 8/2005 McConnell ..... F41B 5/1469 124/35.2
RE38,833 E * 10/2005 Linsmeyer ..... F41B 5/1469 124/35.2

(Continued)

*Primary Examiner* — John A Ricci
(74) *Attorney, Agent, or Firm* — Timothy Stevens; Robert Corbett; Technology Law PLLC

(57) ABSTRACT

A bow release apparatus includes a wrist strap, a body comprising a bow string keeper and a trigger system for releasing a bow string held in the keeper, and at least one elastic band interconnecting the body and the wrist strap. A method of using the bow release apparatus includes fixing the bow string of a bow to the bow string keeper while the bow is drawn by an archer to cause the body to slide along his/her hand to contact the trigger with the stationary trigger finger to actuate the trigger, or hold his/her trigger finger adjacent the trigger of the trigger system to voluntarily actuate the trigger of the trigger system after the bow is drawn to release an arrow from the bow voluntarily.

4 Claims, 5 Drawing Sheets

(56) References Cited

U.S. PATENT DOCUMENTS

| | | | | |
|---|---|---|---|---|
| 6,968,836 | B1 * | 11/2005 | Kees | F41B 5/1469 124/35.2 |
| 7,712,460 | B2 * | 5/2010 | Simo | F41B 5/1469 124/35.2 |
| 8,746,223 | B2 * | 6/2014 | Jones | F41B 5/1469 124/35.2 |
| 2003/0019488 | A1 * | 1/2003 | Eckert | F41B 5/1469 124/35.2 |
| 2006/0048762 | A1 * | 3/2006 | Mitchell | F41B 5/1469 124/35.2 |

* cited by examiner

BOW RELEASE DEVICE AND METHOD

CROSS-REFERENCE TO RELATED APPLICATION

This is a continuation in part of U.S. patent application Ser. No. 16/501,879, filed Jun. 21, 2019, which claims the benefit of U.S. Provisional Application No. 62/763,721, filed Jun. 28, 2018, both of which are hereby incorporated by reference in their entireties.

TECHNICAL FIELD

The instant invention is in the field of archery and more specifically relates to archery bow release devices.

BACKGROUND

One type of bow release device is the trigger actuated recoil motion bow release device (see, for example, U.S. Pat. No. 7,712,460 herein fully incorporated by reference) typically comprising a wrist strap, a first body and a second body, the first body comprising a bow string keeper and a trigger system for releasing a bow string held in the keeper, the second body comprising a coil spring biased plunger extending from the second body and attached to the first body, the second body attached to the wrist strap so that when the bow string of a bow is held by the bow string keeper while the bow is drawn by an archer having the wrist strap attached to the archers draw hand wrist, the archer can actuate the trigger of the trigger system to release the bow string from the bow string keeper and impart a recoil motion to the archers wrist. Another type of bow release device is the back tension bow release wherein the bow string of a drawn bow is released when the bow is drawn sufficiently to automatically release the bow string from the device.

SUMMARY

A bow release apparatus includes a wrist strap, a body comprising a bow string keeper and a trigger system for releasing a bow string held in the keeper, and at least one elastic band interconnecting the body and the wrist strap.

A method of using the apparatus includes attaching the wrist strap to an archer's draw hand wrist, fixing the bow string of a bow to the bow string keeper, and drawing the bow string until the bow string is at or near its fully-drawn position. The method further includes placing a finger adjacent the trigger when the bow string is at or near its fully-drawn position while exerting a force via the wrist strap to elongate the elastic straps and thereby cause the finger to contact the trigger with sufficient force to cause the release of the bow string from the bow string keeper, thereby launching any arrow engaged with the bow string.

DESCRIPTION OF THE PREFERRED EMBODIMENTS

Figure 1:
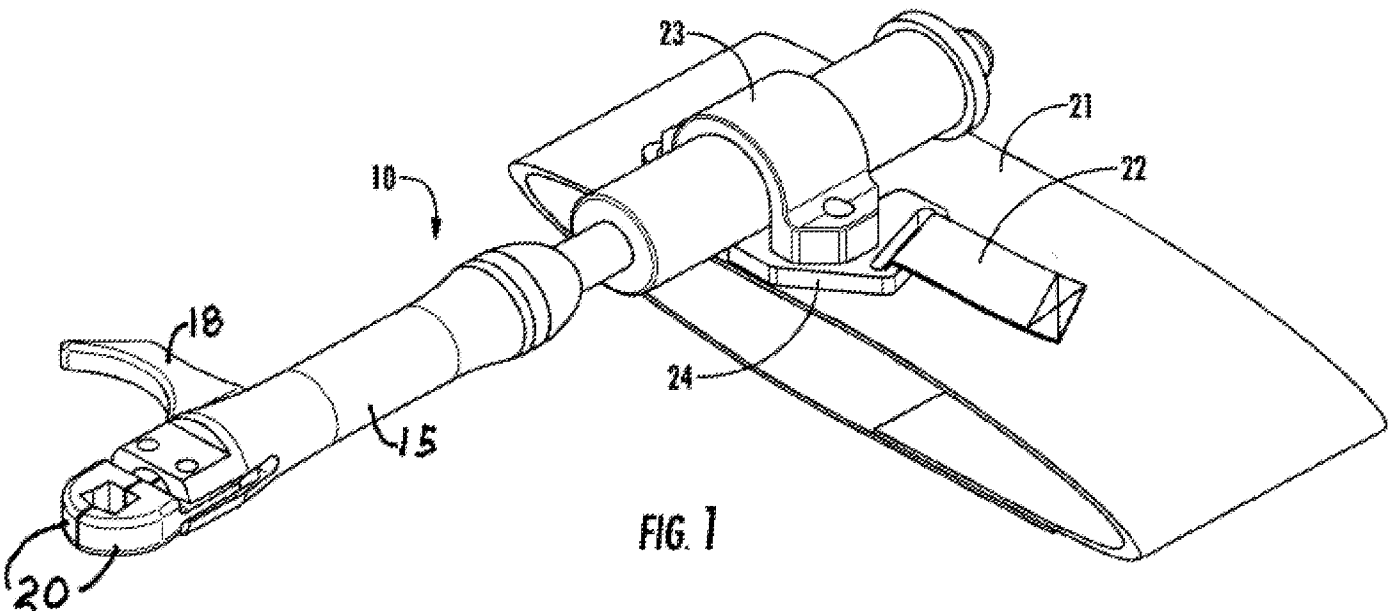
FIG. 1 is a drawing depicting a highly preferred embodiment of the instant invention.
Figure 5:
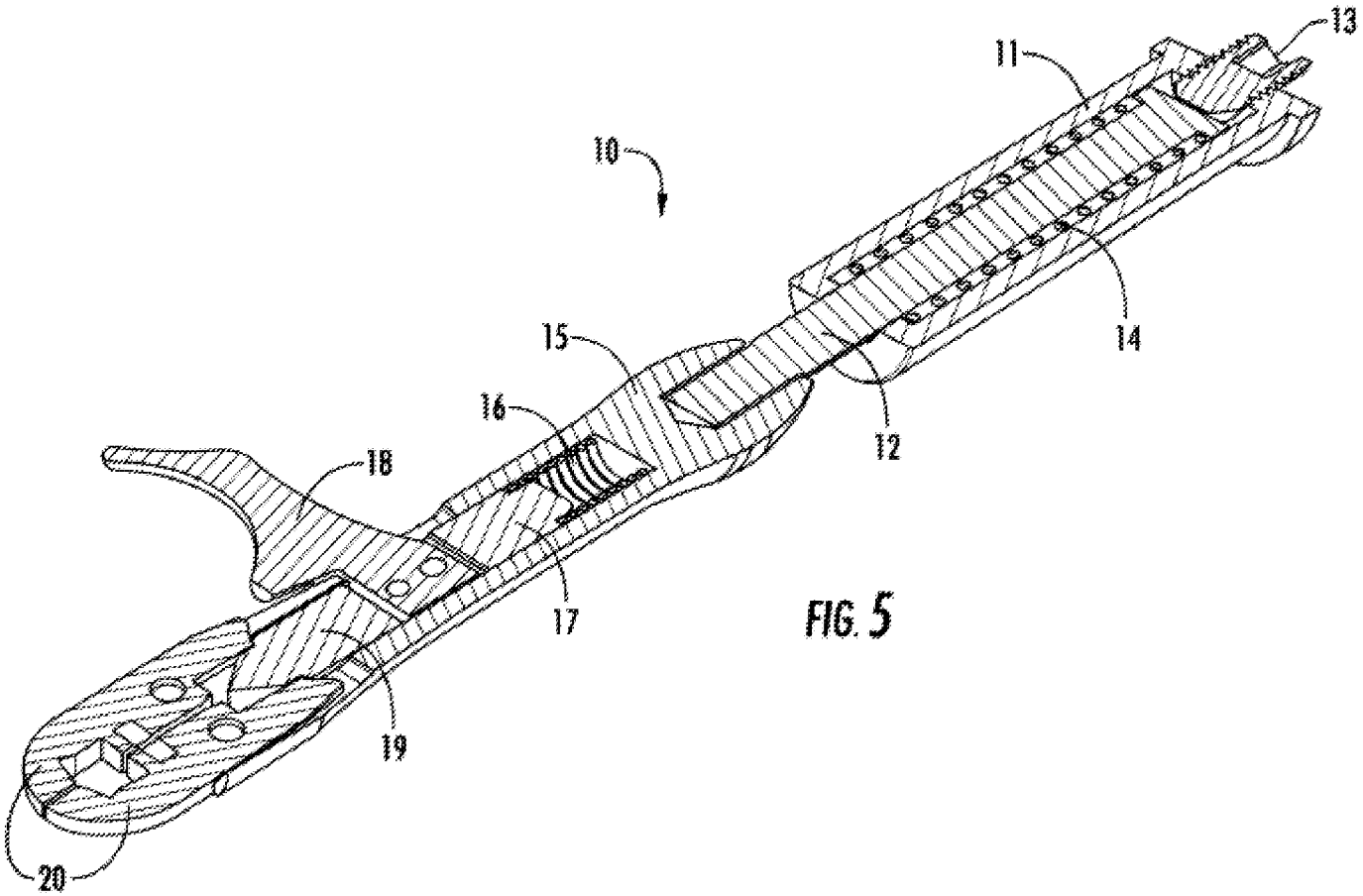
FIG. 5 is a cross-sectional drawing depicting a highly preferred back tension assembly of the instant invention.

Referring now to FIG. 1, therein is shown a highly preferred embodiment of the instant invention comprising first body 15 and second body 11 (see FIG. 5). First body 15 comprises bow string keeper 20 and trigger 18 for releasing a bow string held in keeper 20. Second body 11 comprises a coil spring biasing plunger 12 (see FIG. 5) extending from second body 11 and attached to first body 15. Second body 11 is attached to wrist strap 21 by strap 22 attached to plate 24 and bracket 23. When the bow string of a bow is held by bow string keeper 20 while the bow is drawn by an archer having the wrist strap attached to the archers draw hand wrist, the archer can actuate trigger 18 of the trigger system to release the bow string from bow string keeper 20.

Referring now to FIG. 5, therein is shown a cross-sectional drawing depicting a highly preferred back tension assembly 10 of the instant invention, comprising first body 15, bow string keeper 20, trigger system comprising trigger 18, trigger plunger 17, trigger plunger spring 16 and bow string keeper release plunger 19. Second body 11 comprises coil spring 14, coil spring biased plunger 12 and set screw 13. Coil spring 14 has an uncompressed length of three inches and a spring rate of ten pounds per inch of compression. Coil spring 14 has a compressed length of one inch which compressed length can be adjusted by screwing set screw 13 into or out of second body 11.

Referring again to FIG. 1 and to FIG. 5, a method of using the bow string release devices disclosed herein includes securing the wrist strap 21 to the draw hand of an archer, and then fixing the bow string of a bow to the bow string keeper 20. With the bow string fixed to the bow string keeper 20 and the wrist strap 21 on the wrist, the method further includes drawing the bow by exerting a force on the bow string in a first direction. As the bow is drawn, the bow string will reach a fully-drawn position relative to the bow as understood by those skilled in the art, at which point the amount of force necessary to further draw the bow string or hold the bowstring will be less than the maximum draw force, as understood by those skilled in the art.

The method also includes continuing to exert a force on the bow string in the direction when the bow string is at or near its fully-drawn position so that the coil spring 14 becomes further compressed, which in turn causes the distance between first body 15 and second body 11 to increase.

As the distance between the first body and the second body 11 increases, the archer may hold a trigger finger adjacent trigger 18 such that the relative movement of the second body 11 relative to the first body 15 causes the finger to contact and engage the trigger 18, thereby releasing the bow string from the keeper 20 and any arrow engaging the bow string. More specifically, the first body 15 will slide relative to the archer's finger until the finger contacts the trigger 18, resulting in an almost automatic release of the bow string.

Alternatively, the archer can voluntarily and intentionally cause contact between the finger and the trigger 18 to release the bow string and arrow at any desired time and draw distance.

Figure 2:
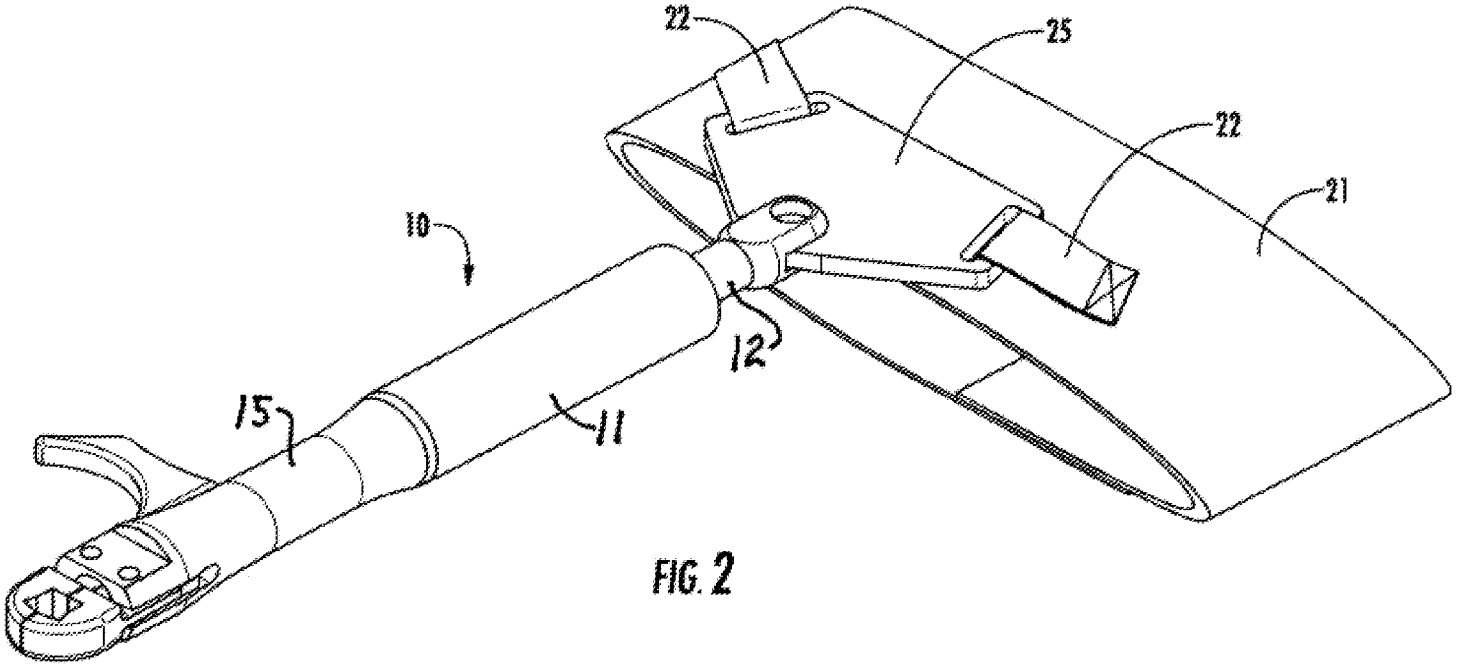
FIG. 2 is a drawing depicting another highly preferred embodiment of the instant invention.
Figure 3:
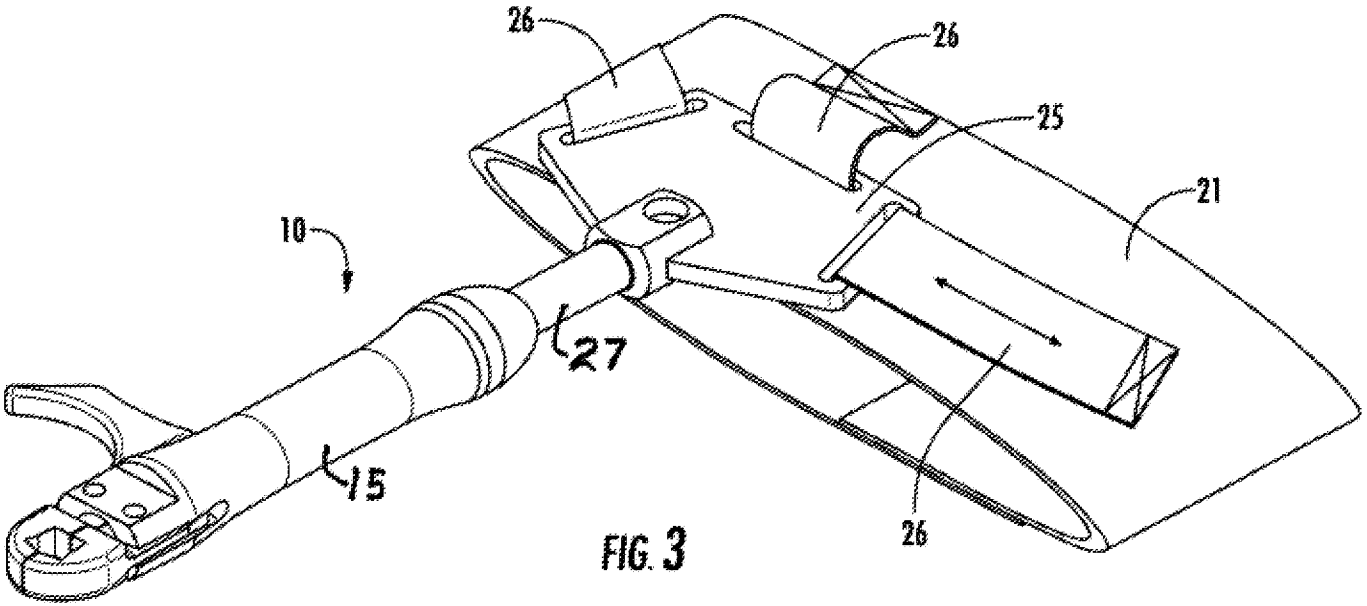
FIG. 3 is a drawing depicting yet another embodiment of the instant invention.

Referring now to FIG. 2, therein is shown a drawing depicting another highly preferred embodiment of the instant invention wherein first body 11 is directly attached to second body 15 and coil spring biased plunger 12 is attached to plate 25 which is attached to wrist strap 21 by strapping 22. Referring now to FIG. 3, therein is shown a drawing depicting another highly preferred embodiment of the instant invention wherein strut 27 attaches first body 15 to plate 25 which is attached to wrist strap 21 by elastic bands 26. In this embodiment, the function of the coil spring is equivalently performed by elastic bands 26. In the embodiment shown, only the two lateral bands 26 are elastic; the shortened band 26 extending rearward from the plate 25 is not elastic and functions to prevent over-extension of the elastic bands while drawing the bow.

A method of using the bow string release device of FIG. 3 includes securing the wrist strap 21 to the draw hand of an archer, and then fixing the bow string of a bow to the bow string keeper 20. With the bow string fixed to the bow string keeper 20 and the wrist strap 21 on the wrist, the method further includes drawing the bow by exerting a force on the bow string. As the bow is drawn, the bow string will reach a fully-drawn position relative to the bow as understood by those skilled in the art, at which point the amount of force necessary to further draw the bow string or hold the bowstring will be less than the maximum draw force, as understood by those skilled in the art. The method also includes continuing to exert a force on the bow string when the bow string is at or near its fully-drawn position so that the elastic bands 26 are elastically deformed in tension, which in turn causes the distance between wrist strap 21 and the trigger 18 to increase.

As the distance between the wrist strap 21 and the trigger 18 increases, the archer may hold a trigger finger adjacent trigger 18 such that the relative movement of the wrist strap 21 relative to the trigger 18 causes the finger to contact and engage the trigger 18, thereby releasing the bow string from the keeper 20 and any arrow engaging the bow string. More specifically, the first body 15 will slide relative to the archer's finger until the finger contacts the trigger 18, resulting in an almost automatic release of the bow string. Alternatively, the archer can voluntarily and intentionally cause contact between the finger and the trigger 18 to release the bow string and arrow at any desired time and draw distance.

Figure 4:
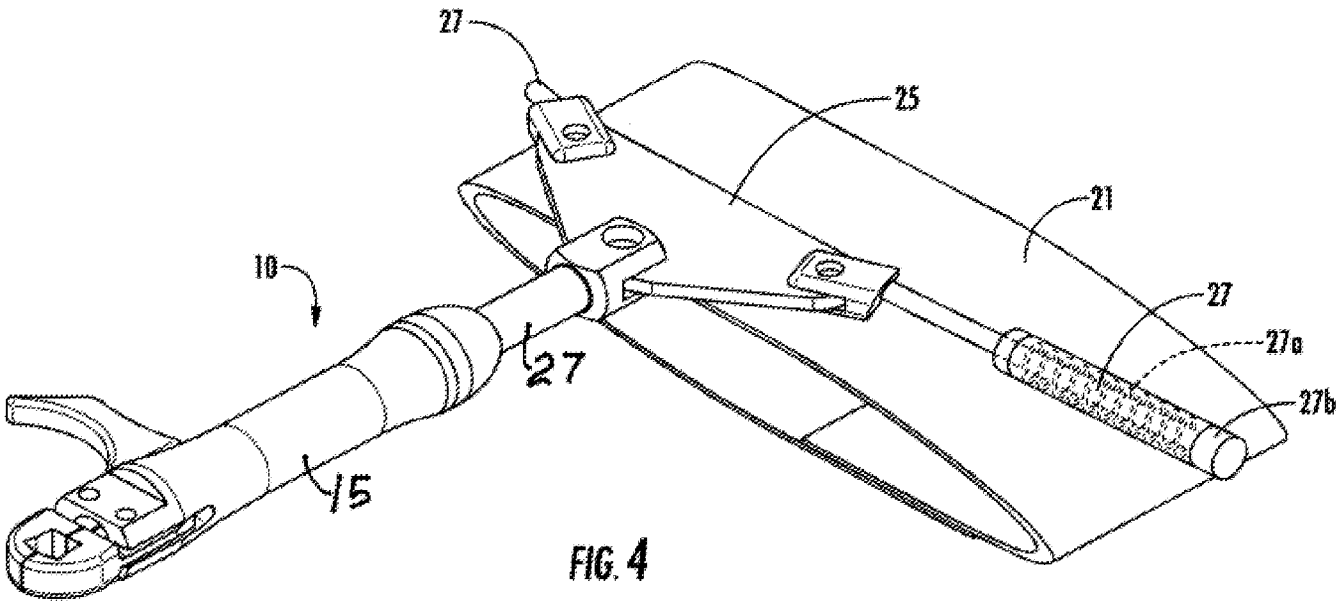
FIG. 4 is a drawing depicting still another embodiment of the instant invention.

Referring now to FIG. 4, therein is shown a drawing depicting another highly preferred embodiment of the instant invention wherein strut 27 attaches first body 15 to plate 25 which is attached to wrist strap 21 by rod 27, spring 27*a* and capsule 27*b*. In this embodiment, the function of coil spring 14 shown in FIG. 5 is equivalently performed by spring 27*a*.

A conventional prior art bow string trigger release of the type disclosed in U.S. Pat. No. 7,712,460 is designed to impart a recoil effect to the archers hand and is not designed for and was not disclosed for back tension release using the method of the instant invention. Thus, using the device and method of the instant invention an archer can select which release is desired or appropriate: (a) a trigger release; or (b) a back tension release. For example, when the archer is target shooting, a back tension release may be appropriate since target shooters often prefer the involuntary release of a back tension release. On the other hand when the archer is hunting, the archer may want a trigger release so that the arrow can be released by finger flexing at a moment selected by the hunter when the animal being hunted is most vulnerable.

The components of the instant invention can be made of any suitable material. It should be understood that the orientation of the coil spring biased plunger used in the instant invention can be attached to the wrist strap as shown, for example and without limitation thereto, as shown in FIG. 2. It should also be understood that incorporating a spring function into the wrist strap as shown in FIG. 3 and FIG. 4 is equivalent to a coil spring biased plunger.

While the best modes for carrying out the invention have been described in detail, those familiar with the art to which this invention relates will recognize various alternative designs and embodiments for practicing the invention within the scope of the appended claims.

The invention claimed is:

1. A bow release for use by an archer to operate a bow having a bow string, the archer having a draw hand wrist and a finger, the bow release comprising:

a wrist strap;

a body comprising a bow string keeper configured to selectively hold the bow string and a trigger system with a trigger for releasing the bow string held in the keeper;

at least one elastic band interconnecting the body and the wrist strap such that, when said wrist strap is engaged with the draw hand wrist, said bow string keeper is holding the bow string, said finger is adjacent the trigger, and said archer exerts a force on said wrist strap, said at least one elastic band transmits the force from the wrist strap to the body thereby elongating said at least one elastic band.

2. The bow release of claim 1, further comprising a strut attached to the body; and a plate attached to the strut;

wherein said at least one elastic band attaches the plate to the wrist strap.

3. The bow release of claim 2, wherein said at least one elastic band includes two elastic bands.

4. A method for an archer to release an arrow from a bow using the bow release of claim 1, comprising:

attaching the wrist strap to an archer's draw hand wrist;

fixing the bow string of a bow to the bow string keeper;

drawing the bow string until the bow string is at or near its fully-drawn position;

placing a finger adjacent the trigger when the bow string is at or near its fully-drawn position while exerting a force via the wrist strap to elongate the elastic straps and thereby cause contact between the finger and the trigger.

* * * * *